US005964405A

United States Patent [19]

Benary et al.

[11] Patent Number: 5,964,405

[45] Date of Patent: Oct. 12, 1999

[54] ARC THERMAL SPRAY GUN AND GAS CAP THEREFOR

[75] Inventors: Raphael Benary, East Northport, N.Y.; Ludwig Dirmeier, Furth; Reinhard Böhm, Northeim, both of Germany

[73] Assignee: Sulzer Metco (US) Inc., Westbury, N.Y.

[21] Appl. No.: 09/027,123

[22] Filed: Feb. 20, 1998

[51] Int. Cl.[6] ..... B05B 1/24

[52] U.S. Cl. ..... 239/84; 239/81; 239/290; 239/296; 219/76.14; 219/76.16

[58] Field of Search ..... 239/79, 81, 83, 239/84, 290, 296, 418, 419, 422; 219/76.14, 76.16, 121.47, 121.51

[56] References Cited

U.S. PATENT DOCUMENTS

| | | | |
|---|---|---|---|
| 2,207,765 | 7/1940 | Stevens | 239/83 |
| 3,443,454 | 5/1969 | Charlop . | |
| 3,901,441 | 8/1975 | Kasagi | 239/81 |
| 4,095,081 | 6/1978 | Ashman | 239/81 X |
| 4,492,337 | 1/1985 | Harrington et al. . | |
| 4,632,309 | 12/1986 | Reimer . | |
| 4,668,852 | 5/1987 | Fox et al. . | |
| 4,720,044 | 1/1988 | Stemwedel, Jr. | 239/84 |
| 5,191,186 | 3/1993 | Crapo et al. . | |
| 5,419,491 | 5/1995 | Breitsprecher | 239/296 X |
| 5,714,205 | 2/1998 | Marantz et al. | 239/83 X |

*Primary Examiner*—Andres Kashnikow
*Assistant Examiner*—Steven J. Ganey
*Attorney, Agent, or Firm*—H. S. Ingham

[57] ABSTRACT

An arc spray gun has a pair of tubular wire guides that guide two metal wires to a point of contact at the wire tips where an arc current through the wires effect an arc, thereby melting the tips. Primary gas channeling on a central axis issues a primary gas flow that atomizes the molten metal and effects a spray stream thereof. A gas cap has at least four orifices arcuately spaced equally about the central axis. The orifices direct secondary gas jets inwardly with a forward directional component toward a point of intersection of the orifice axes on the central axis. The point of intersection is located proximate the point of contact and spaced downstream therefrom sufficiently for the jets not to interfere substantially with the atomization. The spray stream thereby is constricted and accelerated by the secondary gas jets.

29 Claims, 3 Drawing Sheets

ARC THERMAL SPRAY GUN AND GAS CAP THEREFOR

This invention relates to thermal spray apparatus and particularly to a dual wire, arc type of thermal spray gun.

BACKGROUND

Thermal spraying is a process of melting and propelling fine particles of molten material such as metal to form a coating. One type of thermal spray gun is a dual wire, arc thermal spray gun in which two wires are fed into electrical contact at the wire ends. The ends are melted by an electrical arc with current passed through the wires. A jet of compressed gas (usually air) is blown through the tips to atomize (i.e. nebulize) the molten metal and effect a spray stream of molten metal particles. Arc current generally is of the order of hundreds of amperes. Typically the power is brought through cables connected to feed rollers and/or wire guides in the gun that electrically contact the wires and guide them to the point of arcing.

Various configurations for jetting the atomizing air to the melting wire tips have been used in efforts to provide an effective spray stream, and for introducing auxiliary air to modify and improve the spray stream, for example as taught in U.S. Pat. No. 4,668,852 (Fox et al.) However, there has remained a need for improvement in the spray stream, particularly for a higher velocity, narrower spray in order to decrease oxidation of the atomized particles in transit for improved coating quality and deposition efficiency. As atomization in a gun may be satisfactory, it is desirable to improve the spray stream without affecting the arc or the atomization.

SUMMARY

Accordingly, an object of the invention is to provide an improved, dual wire, arc thermal spray apparatus for effecting an improved spray stream. A particular object is to provide such an apparatus for effecting a higher velocity, narrower spray stream. Another object is to provide such an apparatus with a novel secondary gas flow to effect such an improved spray stream without significantly affecting the arc or atomization. A further object is to provide a novel gas cap for such an apparatus in order to achieve the foregoing objects.

The foregoing and other objects are achieved, at least in part, by an arc spray apparatus that includes an arc spray gun with a gun body and a pair of tubular wire guides held convergingly by the gun body so as to guide two metal wires to a point of contact at spraying tips of the wires. A wire feeding mechanism feeds the wires through the wire guides. Primary gas channeling in the gun body on a central axis is located centrally with respect to the wire guides. The wires are receptive of an arc current to effect an arc and thereby molten metal at the spraying tips. The primary gas channeling is receptive of a primary source of compressed gas to issue a primary gas flow for atomization of the molten metal and production of a spray stream thereof.

A gas cap is attached to the gun body coaxially with the central axis. The gas cap has a plurality of at least four orifices arcuately spaced equally about the central axis. The orifices are receptive of a secondary source of compressed gas, and are oriented to direct secondary gas jets inwardly with a forward directional component toward a point of intersection of the orifice axes on the central axis. The point of intersection is located proximate the point of contact and spaced downstream therefrom sufficiently for the jets not to interfere substantially with the atomization. The spray stream thereby is constricted and accelerated by the secondary gas jets.

Objects are also achieved with a gas cap having a structure adapted to fit to a gun body of the above-described arc thermal spray apparatus. The gas cap has the plurality of orifices as in the above-described gas cap.

DETAILED DESCRIPTION

Figure 2:
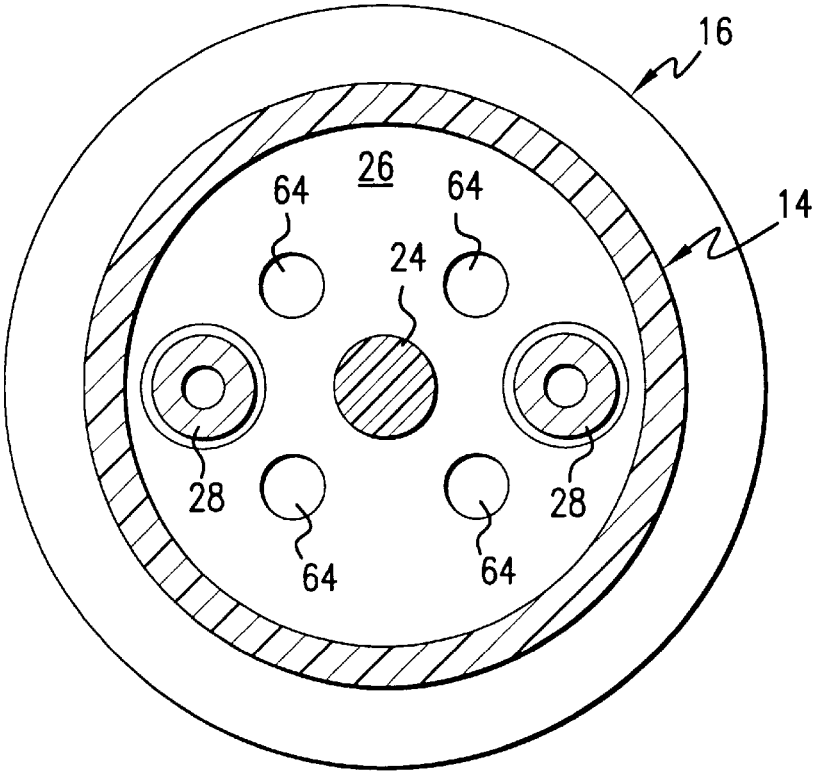
FIG. 2 is a vertical section taken at 2—2 of FIG. 1.
Figure 3:
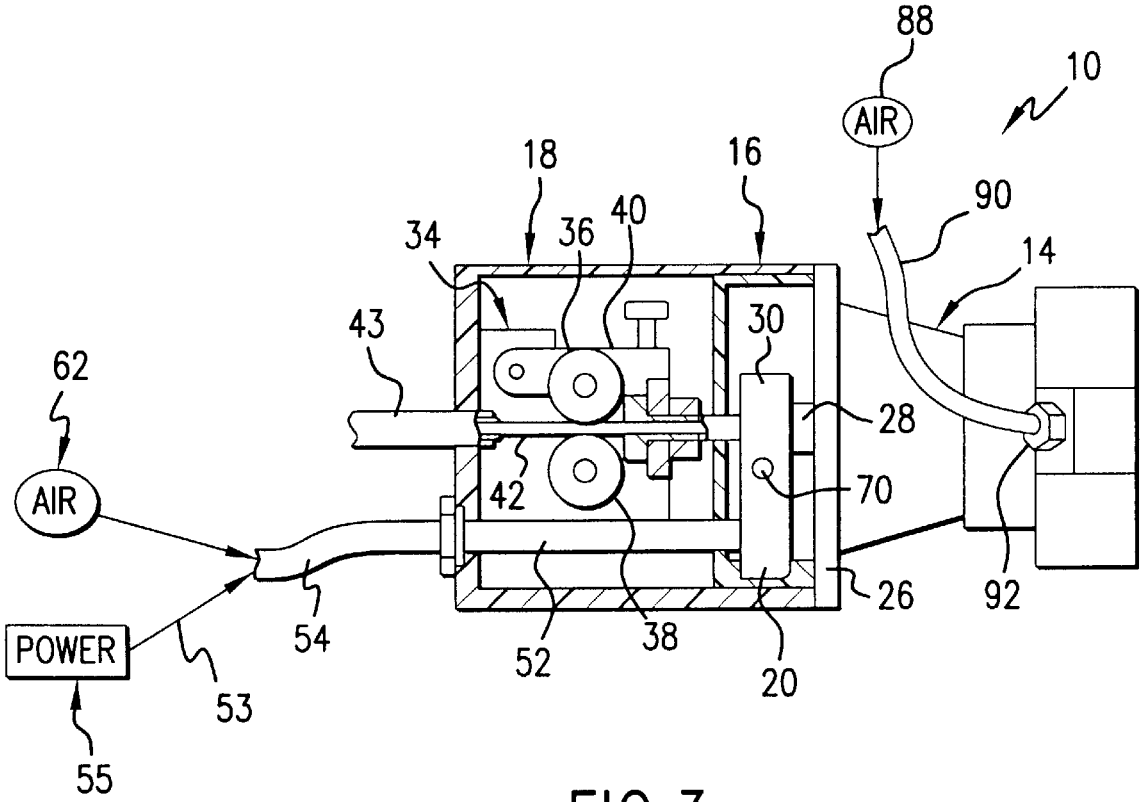
FIG. 3 is a side view of the arc spray gun of FIG. 1, with middle and rear portions in section.

A dual wire, arc thermal spray gun 10 (FIGS. 1–3) incorporating the invention may be a conventional type except with respect to a gas cap described herein. In the present example, a gun body has three portions, namely a forward portion 14, a middle portion 16 and a rear portion 18 (FIG. 3). The middle portion defines a plenum chamber 20. The tapered forward portion delimits a gas cavity 22. A centering post 24 extends forward in the cavity from the partition between the forward and middle portions. Tubular mounting members 28 are positioned in the middle portion by diametric holes in support posts 30 and by a bevel 31 on the forward end of the centering post. Wire guides 32 are attached by threading into the forward ends of the mounting members.

(As used herein and in the claims, the terms "forward" and "front" are with reference to the direction in which the wires are driven, and "rear" and "rearward" denote the opposite direction. The terms "inner" and "inward" mean facing or directed toward the axis.)

The rear portion 18 contains a conventional wire drive mechanism 34. Such a wire drive may utilize a small, variable speed electric motor (not shown) driving crossed-helical gears (not shown) connected to electrically insulated feed rollers 38, with roller tension maintained for each wire with a spring tension device 40 and insulated idler rolls 36. Wires 42 leading through flexible tubing 43 from spools or wire containers (not shown) are thereby fed by the rollers through the guides 32. The type of wire drive is not important to this invention, and any other suitable conventional or other desired mechanism may be used. A push drive at the reels may be used to replace or supplement the wire drive in the gun.

A locating ring 46 for the wire guides is held inside the forward end of the front portion of the gun body by a gas cap 48. A pin 50 prevents rotation of the ring. The gun body 14, 16, 18, centering post 24 and locating ring 46 are constructed of an electrically insulating material such as hard plastic. The body portions are held together conventionally, for example with epoxy or screws. Particularly the rear portion may have a cover with a removable screw for accessibility to the wire drive.

In the present example, electrical contacts are made through the wire guides 32 to the wires 42. Electrical connections to the wire guides are made through the conductive posts 30. Electrically conductive pipes 52 continuing from standard hoses 54 containing power cables from a power source 55 connect respectively to the bases of the posts. The type of electrical contact to the wires is not important to the present invention, and any other conventional or desired contact means such as rollers may be used, and the contact may be effected remotely from the gun such as at the mounting for reels of the wires.

The gas cap 48 is held to the forward gun body by a retaining ring 56 threaded onto the front portion 14 of the gun body. The gas cap is positioned coaxially with a central axis 58 located centrally between the wire guides. The gas cap in the present embodiment has a tapered section 60, rearward of the expanding section, that narrows forwardly to a constricted aperture 61 to form a primary air nozzle directing the atomizing air flow from the chamber 22 to the wire tips 72.

Atomizing air or other gas from a primary source 62 of compressed gas is brought through the hoses 54 into the pipes 52 and up through the posts 30 which are tubular and sealed at their tops. The air then flows through lateral holes 70 in the posts into the manifold chamber 20 in the central portion 16. The air is introduced into the cavity 22 through four holes 64 in the partition 26 from a manifold chamber. O-rings 68 prevent air from leaking back along the retaining members.

The wire guides 32 converge in a forward direction so that the tips (ends) 72 of the metal wires feeding therethrough will contact each other at a point 74 forward of the guides. With a conventional source of arc power (typically DC) applied through the wires, an electric arc will be formed, thus melting the wire ends. The primary gas nozzle, formed by the tapered section 60 of the gas cap, issues the primary jet of air axially through the molten wire tips to atomize and propel a spray stream 76 of molten metal particles (designated schematically by an arrow) to a substrate for deposition. As the contacting of the wires may be in a somewhat amorphous region of arcing, for the present purpose the point of contact 74 is defined as the contact point of the inner, rearward edges of the wires without the arc.

Other styles for the atomizing nozzle may be used. For example a nozzle orifice may be used in place of the tapering section of air cap, as shown in the aforementioned U.S. Pat. No. 4,668,852, the portions thereof relevant to such nozzle and other aspects referenced herein being incorporated herein by reference. Alternatively, two or more gas jets may be utilized, preferably axisymetrically or concentrically, for example concentric passages. However, it is advantageous to incorporate the tapering section into the gas cap, for simplicity and effective atomization.

Figure 4:
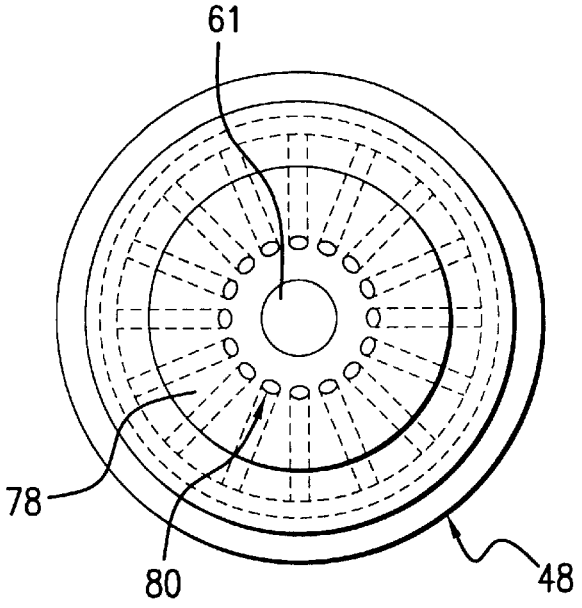
FIG. 4 is a front view of a gas cap for the arc spray gun of FIG. 1.

To encourage a high velocity spray stream, downstream of the atomizing portion, the gas cap 48 preferably has a conically expanding inner surface 78 that surrounds the point of contact 74 for the spraying ends, the expansion being in the downstream (forward) direction. A plurality of at least four orifices 80 are arcuately spaced equally in the gas cap. Generally there should be as many orifices as practical, preferably 10 to 20, such as 16 orifices (FIG. 4). The orifices are receptive of a secondary source of compressed gas (generally air) by way of an annular chamber 82 in the periphery of the gas cap enclosed by the retaining ring 56 and sealed with O-rings 84. A radial duct 86 connects the chamber with a source 88 of compressed air through a gas hose 90 connected to a standard gas fitting 92 on a protuberance 93 on the retaining ring 56.

The orifices 80 are oriented to direct secondary gas jets 94 inwardly with a forward directional component toward a point of intersection 96 of the orifice axes 97 on the central axis 58. The point of intersection is proximate the point of contact 74 but spaced downstream therefrom sufficiently for the secondary gas not to interfere substantially with the atomization, so that the previously established spray steam is constricted and accelerated by the secondary gas, and is maintained with substantially circular cross section. The point of intersection should not be spaced significantly farther from the point of contact than necessary to prevent significant interference. Preferably the point of intersection is located within about 3 cm of the point of contact, and more preferably between about 0.5 cm and 1 cm. The orifices should converge toward the point of intersection on the central axis at an angle with the axis between about 30° and about 40°, for example 35°.

Figure 5:
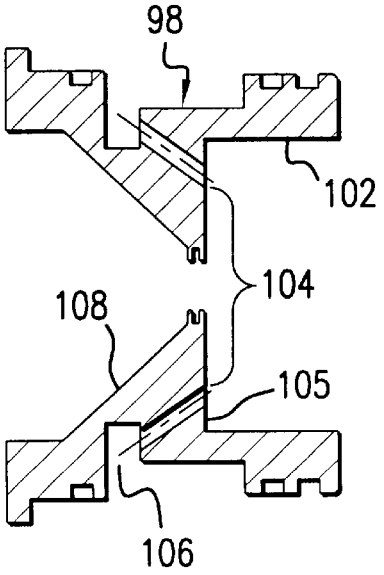
FIG. 5 is a longitudinal section of another embodiment of a gas cap incorporating the invention.

The orifices may be formed simply as drilled holes in the gas cap, as shown, or may be formed in a set of nozzle inserts fitted into such holes. Although an expansion of the surface 78 is desirable, in an another embodiment (FIG. 5), a gas cap 98 has a cylindrical inner surface 102 without an expansion, acting as an arc shield, and a plurality of inwardly-forwardly oriented orifices 104 leading through a forward facing surface 105 from an annulus 106. A forward taper 108 upstream forms an atomizing nozzle as in the previous embodiment. This gas cap can replace the gas cap in the gun of FIG. 1. In other variations, the arc shield 102 may be omitted, and/or the surface 105 may have a shallow, forward taper instead of being flat as shown. In another alternative (not shown) the orifices may lead from the cylindrical surface 102, but this may place the point of intersection 96 too far from the point of contact 74. In a further embodiment (not shown), the orifices may be provided by a ring of pipes held in the appropriate orientations. However, it should generally be advantageous to provide the orifices as simple holes of circular cross section with substantially equal dimensions in the gas cap.

The orifices should be of such size that, under high pressure from the source 88 of compressed gas, choked flows with high velocity are effected toward the spray stream. The orifices should be configured with a high aspect ratio of length to diameter to effect high jet velocity, the aspect ratio preferably being at least 4:1. The orifice diameter should generally be between about 0.5 mm and 2 mm, for example 1.6 mm. The orifices converge toward the point of intersection on the central axis, preferably at an angle with the axis between about 15° and about 80°, and more preferably between about 30° and about 40°. The compressed air source 88 should be regulated to provide an effective jet flow for a desired degree of constricting and narrowing or the spray stream.

If a conical inner surface 78 (FIG. 1) is used, preferably such inner surface diverges from the central axis at an angle between about 30° and about 50° with the axis. The conical surface may have a curvature to optimize gas expansion and acceleration, in which case the forgoing limitations would apply to average divergence.

The secondary source of compressed air (or other gas) may be derived alternatively from the same source as the primary source in the present example by way of a distribution block, for example as taught in the aforementioned U.S. Pat. No. 4,668,852. Moreover, the gas cap of the invention may be used in other styles of two wire arc guns and different types of head members. A gas cap according to the present invention, with the inwardly, forwardly directed orifices, may be fitted to any such gun with appropriate adaptation.

EXAMPLE

Figure 1:
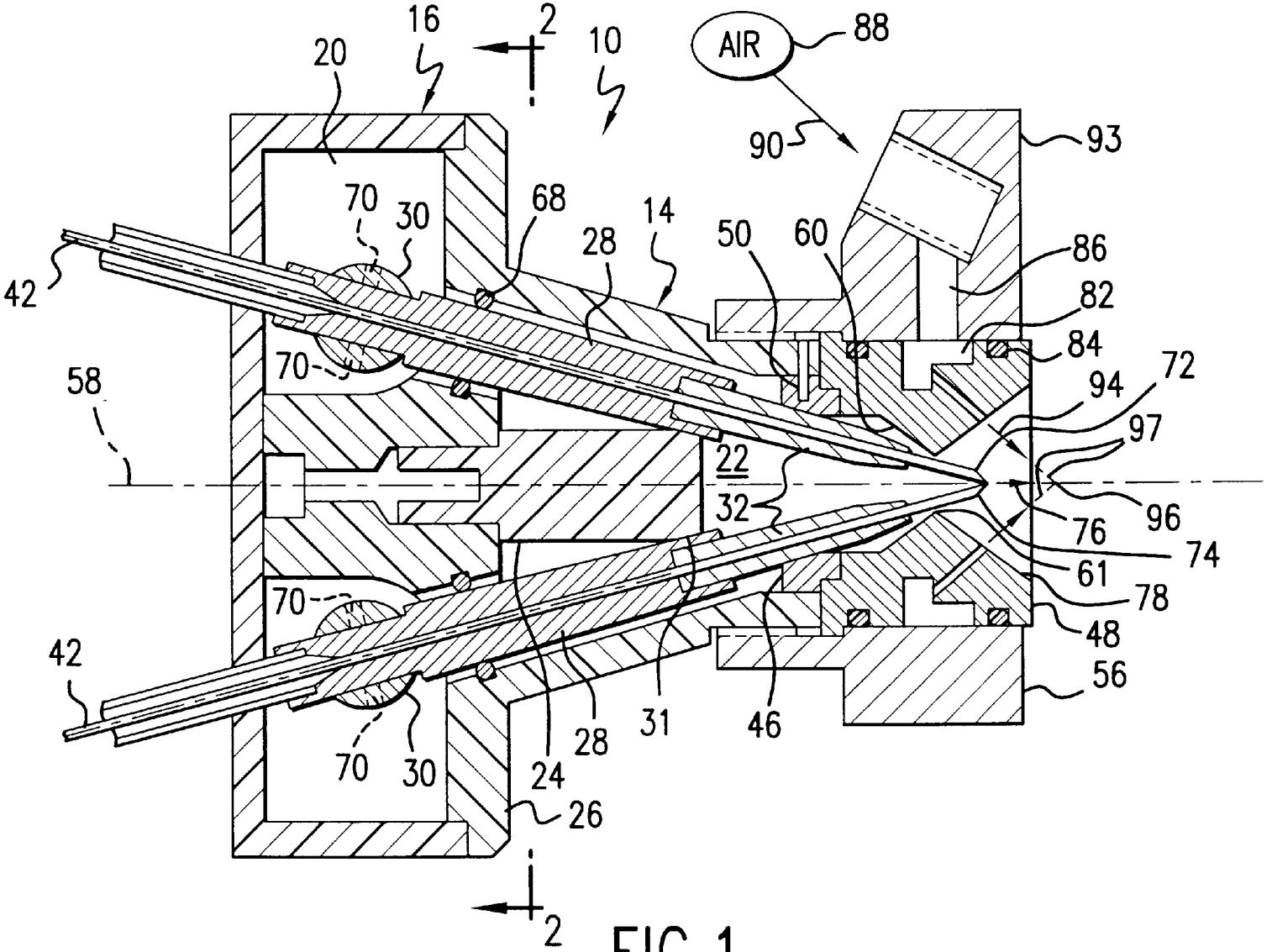
FIG. 1 is a top section of the forward portion of an arc spray gun incorporating the invention.

Spraying was effected with a Sulzer Metco SmartArc™ arc spray gun fitted with a gas cap of the of the type shown in FIG. 1. The smallest inside diameter of the gas cap, at the end of the inward taper, was located 2.5 mm downstream from the wire guide ends. The gas cap had an inner surface diverging an axial distance of 1.2 cm from the smallest diameter at an angle of 40° off the axis to a maximum diameter of 2.6 cm at the exit. The gas cap had 16 orifices of 1.6 mm diameter and an aspect ratio of 7:1, the orifices converging to the point of intersection at an angle of 35° with the gun axis. The point of contact of the wire tips was 1.0 cm downstream from the wire guide ends, and the point of intersection of the orifices on the axis was 8 mm downstream from the point of contact. Stainless steel wire (Sulzer Metco Metcoloy™ #2) of 1.6 mm diameter was sprayed using 250 amperes, 2 bar (80 psi) primary air pressure and 4.8 bar (70 psi) secondary air pressure, and a spraying rate of about 9 kg/hr.

The spray velocity, although not measured quantitatively, was ascertained to be significantly increased over similar spraying without the secondary air flow, as evidenced by higher density, harder coatings that are lower in oxide. Rockwell hardness of the coating was at least 10% greater than that of a conventional coating of the same stainless steel sprayed with similar parameters without secondary air jets. Also a significantly narrower spray stream was produced. With the point of intersection being adjacent to but spaced from the contact point of the wires, the injected secondary air did not significantly affect particle formation from atomization or further atomization, thus keeping oxide levels low in the resulting coating.

While the invention has been described above in detail with reference to specific embodiments, various changes and modifications which fall within the spirit of the invention and scope of the appended claims will become apparent to those skilled in this art. Therefore, the invention is intended only to be limited by the appended claims or their equivalents.

What is claimed is:

1. An arc spray apparatus comprising a spray gun body, a pair of tubular wire guides held convergingly by the gun body so as to guide two metal wires to a point of contact at spraying tips of the wires, a wire feeding mechanism operatively connected to feed the wires respectively through the wire guides, primary gas channeling in the gun body on a central axis located centrally with respect to the wire guides, and a gas cap attached to the gun body coaxially with the central axis, the wires being receptive of an arc current to effect an arc and thereby molten metal at the spraying tips, the primary gas channeling being receptive of a primary source of compressed gas to issue a primary gas flow for atomization of the molten metal and production of a spray stream thereof, the gas cap having a plurality of at least four orifices arcuately spaced equally about the central axis, the orifices being simultaneously receptive of a secondary source of compressed gas and having orifice axes oriented at an angle with the central axis such that the orifices direct secondary gas jets inwardly with a forward directional component toward a point of intersection of the orifice axes on the central axis, the point of intersection being located proximate the point of contact and spaced downstream therefrom sufficiently for the jets not to interfere substantially with the arc and the atomization, and the orifices being of circular cross section with substantially equal dimensions and having an aspect ratio of length to diameter, with the aspect ratio being sufficiently high and the angle being selected so that, with sufficient secondary gas pressure, the spray stream is constricted with substantially circular cross section and accelerated by the secondary gas jets.

2. The arc spray apparatus of claim 1 wherein the plurality of orifices comprises an even number of orifices in pairs of diametrically opposite orifices.

3. The arc spray apparatus of claim 1 wherein the point of intersection is located between about 0.5 and 1 cm from the point of contact.

4. The arc spray apparatus of claim 1 wherein the plurality is between 10 and 20 inclusively.

5. The arc spray apparatus of claim 1 wherein the orifices converge toward the point of intersection on the central axis at an angle with the axis between about 30° and about 40°.

6. The arc spray apparatus of claim 1 wherein the orifices have an aspect ratio of length to diameter of at least 4:1.

7. The arc spray apparatus of claim 1 wherein the gas cap has a forwardly expanding inner surface surrounding the point of contact, with the orifices exiting from the expanding inner surface.

8. The arc spray apparatus of claim 7 wherein the gas cap further has a forwardly tapering inner surface located rearwardly of the expanding inner surface, so as to constrict the primary gas flow to a primary jet to effect the atomization.

9. The arc spray apparatus of claim 7 wherein the expanding inner surface diverges from the central axis at an angle between about 30° and about 50° with the axis, and the orifice axes converge toward the point of intersection on the central axis at an angle with the central axis between about 30° and about 40° with the axis.

10. An arc spray apparatus comprising a spray gun body, a pair of tubular wire guides held convergingly by the gun body so as to guide two metal wires to a point of contact at spraying tips of the wires, a wire feeding mechanism operatively connected to feed the wires respectively through the wire guides, primary gas channeling in the gun body on a central axis located centrally with respect to the wire guides, and a gas cap attached to the gun body coaxially with the central axis, the wires being receptive of an arc current to effect an arc and thereby molten metal at the spraying tips, the primary gas channeling being receptive of a primary source of compressed gas to issue a primary gas flow for atomization of the molten metal and production of a spray stream thereof; wherein:

the gas cap has a plurality of at least four orifices arcuately spaced equally about the central axis, the orifices having orifice axes and being receptive of a secondary source of compressed gas and being oriented to direct secondary gas lets inwardly with a forward directional component toward a point of intersection of the orifice axes on the central axis, the point of intersection being located proximate the point of contact and spaced downstream therefrom sufficiently for the lets not to interfere substantially with the arc and the atomization;

the gas cap further has a forwardly expanding inner surface surrounding the point of contact, with the orifices exiting from the expanding inner surface;

the expanding inner surface diverges from the central axis at an angle between about 30° and about 50° with the axis, and the orifice axes converge toward the point of intersection on the central axis at an angle with the central axis between about 30° and about 40° with the axis; and the plurality of orifices comprises an even number of orifices in pairs of diametrically opposite orifices, the point of intersection is located between about 0.5 cm and 1 cm from the point of contact, and the plurality is between 10 and 20 inclusively, whereby the spray stream is constricted and accelerated by the secondary gas jets.

11. The arc spray apparatus of claim 10 wherein the gas cap further has a forwardly tapering inner surface located rearwardly of the expanding inner surface, so as to constrict the primary gas flow to a primary jet to effect the atomization.

12. A gas cap for an arc spray apparatus, the apparatus including a spray gun body, a pair of tubular wire guides held convergingly by the gun body so as to guide two metal wires to a point of contact at spraying tips of the wires, a wire feeding mechanism operatively connected to feed the wires respectively through the wire guides, and primary gas channeling in the gun body on a central axis located centrally with respect to the wire guides, the wires being receptive of an arc current to effect an arc and resulting molten metal at the spraying tips, and the primary gas channeling being receptive of a primary source of compressed gas to issue a primary gas flow for atomization of the molten metal and production of a spray stream thereof; wherein:

the gas cap comprises a cap structure adapted to fit the gas cap to the gun body coaxially with the central axis, the gas cap having a plurality of at least four orifices arcuately spaced equally about the central axis, such that, with the gas cap fitted to the gun body, the orifices are simultaneously receptive of a secondary source of compressed gas, the orifices having orifice axes oriented at an angle with the central axis such that the orifices direct secondary gas jets inwardly with a forward directional component toward a point of intersection of the orifice axes on the central axis, the point of intersection being located proximate the point of contact and spaced downstream therefrom sufficiently for the jets not to interfere substantially with the arc and the atomization, and the orifices being of circular cross section with substantially equal dimensions and having an aspect ratio of length to diameter, with the aspect ratio being sufficiently high and the angle being selected so that, with sufficient secondary gas pressure, the spray stream is constricted with substantially circular cross section and accelerated by the secondary gas jets.

13. The gas cap of claim 12 wherein the plurality of orifices comprises an even number of orifices in pairs of diametrically opposite orifices.

14. The gas cap of claim 12 wherein the point of intersection is located between about 0.5 and 1 cm from the point of contact.

15. The gas cap of claim 12 wherein the plurality is between 10 and 20 inclusively.

16. The gas cap of claim 12 wherein the orifices converge toward the point of intersection on the central axis at an angle with the axis between about 30° and about 40°.

17. The arc spray apparatus of claim 12 wherein the orifices have an aspect ratio of length to diameter of at least 4:1.

18. The gas cap of claim 12 wherein the gas cap has a forwardly expanding inner surface surrounding the point of contact, with the orifices exiting from the expanding inner surface.

19. The gas cap of claim 18 wherein the gas cap further has a forwardly tapering inner surface located rearwardly of the expanding inner surface, so as to constrict the primary gas flow to a primary jet to effect the atomization.

20. The gas cap of claim 18 wherein the inner surface diverges from the central axis at an angle between about 30° and about 50° with the axis, and the orifices converge toward the point of intersection on the central axis at an angle with the axis between about 30° and about 40° with the axis.

21. A gas cap for an arc spray apparatus, the apparatus including a spray gun body, a pair of tubular wire guides held convergingly by the gun body so as to guide two metal wires to a point of contact at spraying tips of the wires, a wire feeding mechanism operatively connected to feed the wires respectively through the wire guides, and primary gas channeling in the gun body on a central axis located centrally with respect to the wire guides, the wires being receptive of an arc current to effect an arc and resulting molten metal at the spraying tips, and the primary gas channeling being receptive of a primary source of compressed gas to issue a primary gas flow for atomization of the molten metal and production of a spray stream thereof; wherein:

the gas cap comprises a cap structure adapted to fit the gas cap to the gun body coaxially with the central axis, the gas cap having a plurality of at least four orifices arcuately spaced equally about the central axis, the orifices having orifice axes and being receptive of a secondary source of compressed gas and being oriented to direct secondary gas lets inwardly with a forward directional component toward a point of intersection of the orifice axes on the central axis, the point of intersection being located proximate the point of contact and spaced downstream therefrom sufficiently for the lets not to interfere substantially with the arc and the atomization;

the gas cap further has a forwardly expanding inner surface surrounding the point of contact, with the orifices exiting from the expanding inner surface;

the inner surface diverges from the central axis at an angle between about 30° and about 50° with the axis, and the orifices converge toward the point of intersection on the central axis at an angle with the axis between about 30° and about 40° with the axis; and the plurality of orifices comprises an even number of orifices in pairs of diametrically opposite orifices, the point of intersection is located between about 0.5 cm and 1 cm from the point of contact, and the plurality is between 10 and 20 inclusively, whereby the spray stream is constricted and accelerated by the secondary gas jets.

22. The gas cap of claim 21 wherein the gas cap further has a forwardly tapering inner surface located rearwardly of the expanding inner surface, so as to constrict the primary gas flow to a primary jet to effect the atomization.

23. A gas cap for an arc spray gun, comprising a cap structure adapted to fit the gas cap to a gun body of a two-wire arc spray gun coaxially with a central axis, the gas cap having a plurality of at least four orifices arcuately spaced equally about the central axis, such that, with the gas cap fitted to the gun body, the orifices are simultaneously receptive of a secondary source of compressed gas, the orifices being of substantially equal dimensions and having orifice axes converging toward a point of intersection on the central axis at an angle with the central axis between about 30° and about 40°, and the orifices having an aspect ratio of length to diameter of at least 4:1.

24. The gas cap of claim 23 wherein the plurality of orifices comprises an even number of orifices in pairs of diametrically opposite orifices, and the plurality is between 10 and 20 inclusively.

25. The gas cap of claim 23 wherein the gas cap has a forwardly expanding inner surface surrounding the point of contact, with the orifices exiting from the expanding inner surface.

26. The gas cap of claim 24 wherein the gas cap further has a forwardly tapering inner surface located rearwardly of the expanding inner surface.

27. The gas cap of claim 25 wherein the inner surface diverges from the central axis at an angle between about 30° and about 50° with the axis.

28. The gas cap of claim 27 wherein the plurality of orifices comprises an even number of orifices in pairs of diametrically opposite orifices, the point of intersection is located between about 0.5 cm and 1 cm from the point of contact, and the plurality is between 10 and 20 inclusively.

29. The gas cap of claim 28 wherein the gas cap further has a forwardly tapering inner surface located rearwardly of the expanding inner surface, so as to constrict the primary gas flow to a primary jet to effect the atomization.

* * * * *

UNITED STATES PATENT AND TRADEMARK OFFICE

CERTIFICATE OF CORRECTION

PATENT NO. : 5,964,405

DATED : 10/12/99

INVENTOR(S) : Ralph Benary, Ludwig Dirmeier, Reinhard Bohm

It is certified that error appears in the above-identified patent and that said Letters Patent is hereby corrected as shown below:

| | |
|---|---|
| **Claim 10, Column 6, Line 46,** | **Delete "lets" and insert --jets--** |
| **Claim 10, Column 6, Line 50,** | **Delete "lets" and insert --jets--** |
| **Claim 21, Column 8, Line 21,** | **Delete "lets" and insert --jets--** |
| **Claim 21, Column 8, Line 26,** | **Delete "lets" and insert --jets--** |

Signed and Sealed this

Ninth Day of May, 2000

*Attest:*

Q. TODD DICKINSON

*Attesting Officer*

*Director of Patents and Trademarks*